US005113635A

United States Patent [19]

Takai et al.

[11] Patent Number: 5,113,635

[45] Date of Patent: May 19, 1992

[54] APPARATUS FOR AUTOMATICALLY FEEDING AND PACKING SURIMI OF FISH OR SHELLFISH

[75] Inventors: Hiroshi Takai, Tokyo; Sachio Ishida, Shizuoka, both of Japan

[73] Assignees: Nippon Suisan Kaisha Ltd., Tokyo; Ishida Iron Works, Co., Ltd., Shizuoka, both of Japan

[21] Appl. No.: 632,682

[22] Filed: Dec. 24, 1990

[30] Foreign Application Priority Data

Dec. 28, 1989 [JP] Japan ..... 1-343415

[51] Int. Cl.[5] ..... B65B 3/08; B65B 3/26

[52] U.S. Cl. ..... 53/52; 53/517; 53/530; 53/550; 452/31; 452/44

[58] Field of Search ..... 53/523, 530, 52, 77, 53/122, 113, 550, 450, 517; 452/44, 31, 40, 35

[56] References Cited

U.S. PATENT DOCUMENTS 2,038,247 4/1936 Stallman ..... 452/44
2,889,574 6/1959 Thielen et al. ..... 452/44 X
3,034,171 5/1962 Rosenthaler ..... 452/31
3,118,173 1/1964 Anderson et al. ..... 452/31
3,202,084 8/1965 Hale et al. ..... 53/530 X
4,625,362 12/1986 Kollross et al. ..... 452/31 X

*Primary Examiner*—James F. Coan
*Attorney, Agent, or Firm*—Sughrue, Mion, Zinn, Macpeak & Seas

[57] ABSTRACT

An apparatus for automatically feeding and packing surimi of fish or shellfish, including a feed hopper having a top inlet for feeding the surimi therefrom and a bottom outlet for discharging the surimi therefrom. A screw feeder connected to the bottom outlet of the fed hopper has two screws for passing the surimi through the screw feeder. A feed pump feeds a predetermined quantity of the surimi flowing out from an exit of the screw feeder in which the predetermined quantity of the surimi is formed into a desired shape by a forming tube. A wrapping tube forming device forms a plastic film into a continuous wrapping tube to be packed with the surimi.

8 Claims, 6 Drawing Sheets

APPARATUS FOR AUTOMATICALLY FEEDING AND PACKING SURIMI OF FISH OR SHELLFISH

PRIOR ART

Generally, immediately after being caught, fish or shellfish, such as Alaska pollak, Atkamacherel, Golden threadfin beam or the like, is subjected to the sequential steps, such as removing the non-edible portions therefrom to collect the edible portions only, bleaching the resultant edible portions using water, removing water contained in the bleached edible portions, thereby carrying out a preparation of surimi of fish or shellfish. The resultant surimi is divided into several units with a predetermined weight and then each unit is wrapped with wrapping materials, such as a plastic bag or the like.

However, surimi with a structure comprising mainly of large and hard fibrous elements does not evenly flow during the operational steps of dividing and wrapping thereof. Therefore, it is very difficult to effect a continuous and accurate division of surimi into units with a predetermned weight and then to wrap each unit with wrapping materials, i.e., a plastic bag, by utilizing a conventional dividing and wrapping machine, such as an automatic fish sausage making machine as shown in FIG. 4. Namely, as described above, surimi consists mainly of fibrous elements which results from chopping the edible portions of fish or shellfish by using a conventional chopper, thereafter bleaching them or removing water from them. On the contrary, a meat paste of fish or shellfish is resulted from a disolution of salt soluble protein contained in the edible portions of fish or shellfish, which disolution arises during kneading the edible portions 10 with salt.

Consequently, usage of the conventional automatic sausage making machine enables the continuous and accurate dividing and wrapping of the meat paste, because the meat paste is capable of flowing through the machine. On the contrary, by using a conventional automatic sausage making machine, it is impossible to continuously divide surimi into units even if the surimi has a constant weight and to uniformly wrapped each unit, because the surimi cannot flow through the machine.

In detail, FIG. 4 shows an example of a conventional automatic sausage making machine for effecting a continuous and accurate dividing of meat paste of fish or shellfish, thereby automatically manufacturing a sausage of fish or shellfish.

The automatic sausage making machine comprises a hopper 1 having a conical shape thereon and is disposed on the floor. The hopper 1 has the lower portion connected with a pair of feeding rollers 2. Meat paste 3 is subjected to flowing out by the pair of feed rollers 2 and entering a suction pump 4. The suction pump 4 includes an outlet connected with a feed pipe 5. The feed pipe 5 has an upwardly extending portion, through which meat paste 3 is raised and then fed onto a feed pump 6. The feed pump 6 has an outlet connected with a nozzle 7. On the outer circumference of the nozzle 7, a plastic film 8 is continuously supplied, so as to form an overlap portion 8*a* by overlapping opposed marginal sides of the film 8. By heat sealing the overlap portion 8*a*, wrapping tube 9 is formed, with which meat paste 3 is packed.

Underneath the nozzle 7, a pair of squeezing rollers 10 are disposed. A local squeeze of tube 9 by the squeezing rollers 10 forces out the meat paste 3 from the squeezed portion of tube 9, thereby forming empty portions without meat paste. Empty portions in sequence are sealed in a predetermined interval along the length-wise direction of the tube 9. Namely, the formation of each empty portion makes a division of meat paste into units each having a predetermined weight. Each empty portion is sealed with a wire clip 11 or the like, thereby resulted in automatically manufacturing a fish sausage comprising the wrapping tube 9 and the meat paste 3 packed therewith.

Now, with packing surimi by using the automatic sausage making machine shown in FIG. 4, surimi must be subjected in sequence to steps, such as squeezing the wrapping tube 9 using rollers 10 to force the surimi from the squeezed portion of the wrapping tube 9 so as to form empty portions in sequence, and sealing each empty portion of the wrapping tube 9 with a wire clip 10, as the surimi flows out along a downward direction through the feed pump 6.

To this end, surimi has to be lifted from the bottom of the hopper 1 upto the top of the feed pump 6 via the feed tube 5, by using the suction pump 4.

However, the surimi does not necessarily flow through the feed tube 6, because the surimi has a structure comprising large and hard fibrous elements. Consequently, it can not easily be lifted to the top of the feed pump 6, even by increasing the suction capacity of pump 4. Particularly, it is almost impossible to feed surimi having a constant density. Further, it is very difficult to completely force the surimi from the tube 9 by squeezing the wrapping tube 9 through a pair of squeezing rollers 10. Namely, due to an adherence of surimi to the inner wall surface of the squeezed portion of the wrapping tube 9 it is impossible to form empty portions in sequence along a line of the wrapping tube 9. In detail, owing to a contamination of the inner wall of the squeezed portion of a tube with surimi, the squeezed portion cannot be sealed by heat sealing.

In view of the above, the inventors proposed a horizontal type apparatus for wrapping and packing surimi to meet the chracteristics of surimi, as described in Japanese Patent publication No. 35810/1986. The apparatus is shown in FIG. 5.

Referring to FIG. 5, a feed hopper 12 has its top portion to continuously supply surimi 3*a*. In the bottom of the feed hopper 12, a screw feeder 13 consisting of a pair of screws is disposed such that they extend obliquely upwards. The screw feeder 13 has an outlet connected with a gear pump 14.

The gear pump 14 has an exit connected with a forming tube 15. Because of the screw feeder 13, even if the gear pump 14 has a suction force insufficient to draw surimi 3*a*, surimi 3*a* will still be drawn to the gear pump 14 and sequent feeding of surimi 3*a* to the forming tube 15, by the aid of the screw feeder 13.

Surimi 3*a* is formed into a desired shape as it passes through the forming tube 15. A plastic film 8 is continuously supplied onto the outer periphery of the forming tube 15, on which it is continuously formed through a forming bar 17 into a wrapping tube. More specifically, the film 8 is rewound off a film roll 16, and as it proceeds along the forming bar 17, it is covered over on the outer periphery of forming tube 15, so as to form its overlap portion by overlapping opposed marginal sides thereof. The overlap portion (not shown) is sealed by a heat sealer 18, thereby forming a wrapping tube 20. The wrapping tube formed in this way is fed continuously by the feed roller 19. Surimi having a desired shape is packed into the wrapping tube 20 at it flows out from the exit of the forming tube 15. In this apparatus, a periodical driving of the gear pump 14 feeds the surimi 3*a* into the forming tube 15, and a periodical stopping of the gear pump 14 forms empty portions in sequence to be sealed on the wrapping tube 20. The empty portion 21 is cut and simultaneously heat sealed by the cutter/-sealer 22. In this way, surimi 3*a* is divided into units each having a predetermined length, and also each unit is wrapped with the wrapping tube 20.

Adjacent to the outlet of the forming tube 15, a lower cutter 23, which can be raised and lowered, is provided beneath the top level of the forming tube 15. Any upper cutter corresponding to the lower cutter 23 is not provided. At the time of periodical stopping the gear pump 14, the lower cutter 23 stops its raising motion when it reaches the top level of the forming tube, and then commences it's lowering motion. The lower cutter 23 has a cutting edge with a rounded portion on a tip thereof. Thus, when the lower cutter 23 reaches the top level of the forming tube 15, a downward force is applied to the rounded edge portion of the cutter 23 by the tension of the wrapping tube 20, so that only surimi 3*a* can be cut into several units, without cutting the wrapping tube 20.

After the cutter 23, a feed conveyor 24 is provided, and the cutter/sealer 22 is detachably provided on the feed conveyor 24. In its starting position, the cutter/-sealer 22 is secured to the feed conveyor 24 and sequently moved along with the feed conveyor 24 till it reaches the end position. In its ending position, the cutter/sealer 22 is separated from the feed conveyor 24 and then returned to the starting position by an extention of a returning piston 25. Namely, as shown in FIG. 6, the cutter/sealer 22 comprises a reciprocal base 221, a pair of support posts 222, a central guide roller 223 and a pair of opposite side guide rollers 224. A heat sealer 225 and a cutter 226 are disposed between a pair of support posts 222 such that the heat sealer 225 and the cutter 226 can be raised and lowered, respectively. Further, a connecting element 227 for securing the cutter/sealing 22 to the feed conveyor 24 or for separating the cutter/sealer 22 from the conveyor 24 is provided. The feed conveyor 24 is passed through the central guide roller 223 and a pair of opposite side rollers 224. In the starting position, the cutter/sealer 22 is secured to the feed conveyor 24 by an engagement of the connecting element 227. When the cutter/sealer 22 reaches the ending position, by a disengagement of the connecting element 227, the cutter/sealer 22 is separated from the feed conveyor 24. At this instance, the cutter/sealer 22 is returned to the initial starting position by extension of the returning piston 25. While the cutter/sealer 22 is moved along with the feed conveyor 24 from the starting position to the ending position, the wrapping tube 20 is heat sealed by the upper and lower heat sealers 225 to form a sealing portion vertical to the length-wise direction thereof and then a portion adjacent to the sealing portion is cut by the cutter 226. The feed conveyor 24 is moved by guide rollers 241 to 244 and a drive roller 245, and the drive roller 245 is driven by a main drive motor 26, of which torque is transmitted to the feed roller 19, via a belt 261, a pair of gears 281 and 282, belt 27, a pulley 283 and a belt 271. The wrapping tube 20 is moved forwards by the feed roller 19.

With the apparatus having such construction, there are not provided means for interconnecting between the screw feeder 13 and the forming tube 15. Therefore, when an extreme drop of surimi feeding pressure applied by the screw feeder 13 results causes due to a descrease in surimi feeding rate by a reduction of the amount surimi fed to the feed hopper 12, or when a fluctuation of the surimi feeding pressure applied by the screw feeder 13 results due to the other inevitable reasons, merely controlling the revolution rate of the gear pump 14 does not form the surimi with an uniform density through the forming tube 15 or form an accurate division of surimi into units each with a constant weight. This leads to fatal defects of the apparatus for automatically wrapping and packing surimi, because division of surimi into units each with the constant weight depends on the density of surimi fed to the gear pump 14.

Further, while surimi having fibrous structure is fed by the gear pump 14, it is subjected to cutting the fiber structure into small pieces and kneeding a meat portion of the surimi into a paste material, thus greatly spoiling the character or the quality of surimi.

Furthermore, during a movement of the cutter/sealer 22 shown in FIG. 6 along with the feed conveyor 24, the wrapping tube 20 including a sequence of surimi units is heat sealed on its empty portion formed between adjacent surimi units, by a pair of heat sealers 225 and the resultant sealing portion forms a bottom portion for supporting a surimi unit. The the bottom portion is then cut along its marginal edge by a pair of cutters 226, thereby resulting in a packing bag with an inlet thereof remaining opened. Therefore, each surimi unit cannot be filled upto the inlet of the packing bag.

Finally, with the cutter/sealer 22, it is with difficulty to effect adequate controls of heat sealing and cutting of the wrapping tube 20, during a movement of the cutter/sealer 22 along with the feed conveyor 24. Especially, due to a lack of development of control means, it is impossible to effect with a high accuracy practical wrapping and packing of surimi.

PROBLEMS TO BE SOLVED ACCORDING TO THE INVENTION

An object of the invention is to eliminate the above drawbacks. Especially, the drawbacks are precluded by a provision of an apparatus for automatically feeding and packing surimi of fish or shellfish, in which a predetermined quantity of surimi is packed with high accuracy with a plastic film wrapping tube, using a feed hopper and a screw feeder. Namely, according to the apparatus, when the surimi pressure of surimi flowing out from the screw feeder and the level formed by surface of the surimi occupying the feed hopper reach a reference range, the feeding of surimi from the screw feeder commences, thereby achieving an automatic and accurate feeding and packing of the surimi.

The invention is predicated on the fact that for automatically and continously feeding surimi without spoiling the character thereof it is suitable to use as feed pump a volume type pump consisting of a pair or rotors in lieu of a gear pump. However, the volume type pump does not have a suction capacity sufficient to withdraw the surimi. Consequently, a screw feeder is provided for withdrawing surimi from the volume type pump.

Further, to maintain a constant density of the surimi supplied to the volume type pump, the surimi pressure prevailing over the inlet of the volume type pump and also the feed level of the surimi occupying in the hopper are detected, thereby maintaining the surimi pressure and the feed level within a constant level. Further, a communication chamber having a volume sufficient for maintaining a constant surimi density is provided betwen the inlet of the volume type pump and outlet of the screw feeder, and also a return path is formed in the screw feeder including two screws with a loose mesh each other. When surimi pressure prevailing in the communication chamber is increased beyond a predetermined pressure, surimi is caused to flow back through the return path, thus maintaining a constant density in the communication chamber.

MEANS AND FUNCTION FOR SOLVING PROBLEMS

According to the invention, there is provided an apparatus for automatically feeding and packing surimi of fish or shellfish, comprising a feed hopper including a top inlet of feeding surimi therefrom and a bottom outlet for discharging surimi therefrom, a screw feeder connected to the bottom outlet of the feed hopper, the screw feeder having two screws serving to pass the surimi through the screw feeder, a feed pump for feeding a predetermined quantity of the surimi flowing out from an exit adjoining a leading end of the screw feeder, a forming tube for forming into a desired shape the surimi flowing out from the oulet of the feed pump, and a wrapping tube forming means for forming a plastic film into a continuous wrapping tube to be packed with said surimi. In this apparatus, there are provided with a communication chamber disposed between the screw feeder and said feed pump, a pressure gauge disposed at the communication chamber, which pressure gauge serves to detect a surimi pressure prevailing in the communication chamber, a level gauge disposed at the communication chamber, which level gauge serves to detect a feed level formed by a surface of the surimi within the feeding hopper, control means for supplying a driving singnal to the feed pump only when the level gauge detects the feed level equal or above a reference level and simultaneously the pressure gauge detects the surimi pressure in excess of a reference pressure and a return path formed between two screws, Further, according to the invention, in the screw feeder, the return path causes surimi to flow back between two screws disposed with a deviation of 0.3 to 0.7 times an unit pitch of each screw. Even if the surimi pressure prevailing in surroundings of the outlet of the screw feeder or the communication chamber is in excess of a predetermined range, the surimi flows back through the return path. Therefor, the surimi pressure prevailing in the communical chamber can be always maintained at a constant value.

BRIEF EXPLANATIONS OF ATTACHED DRAWINGS

DETAILED EXPLANATION OF THE PREFERRED EMBODIMENT OF THIS INVENTION

Figure 1:
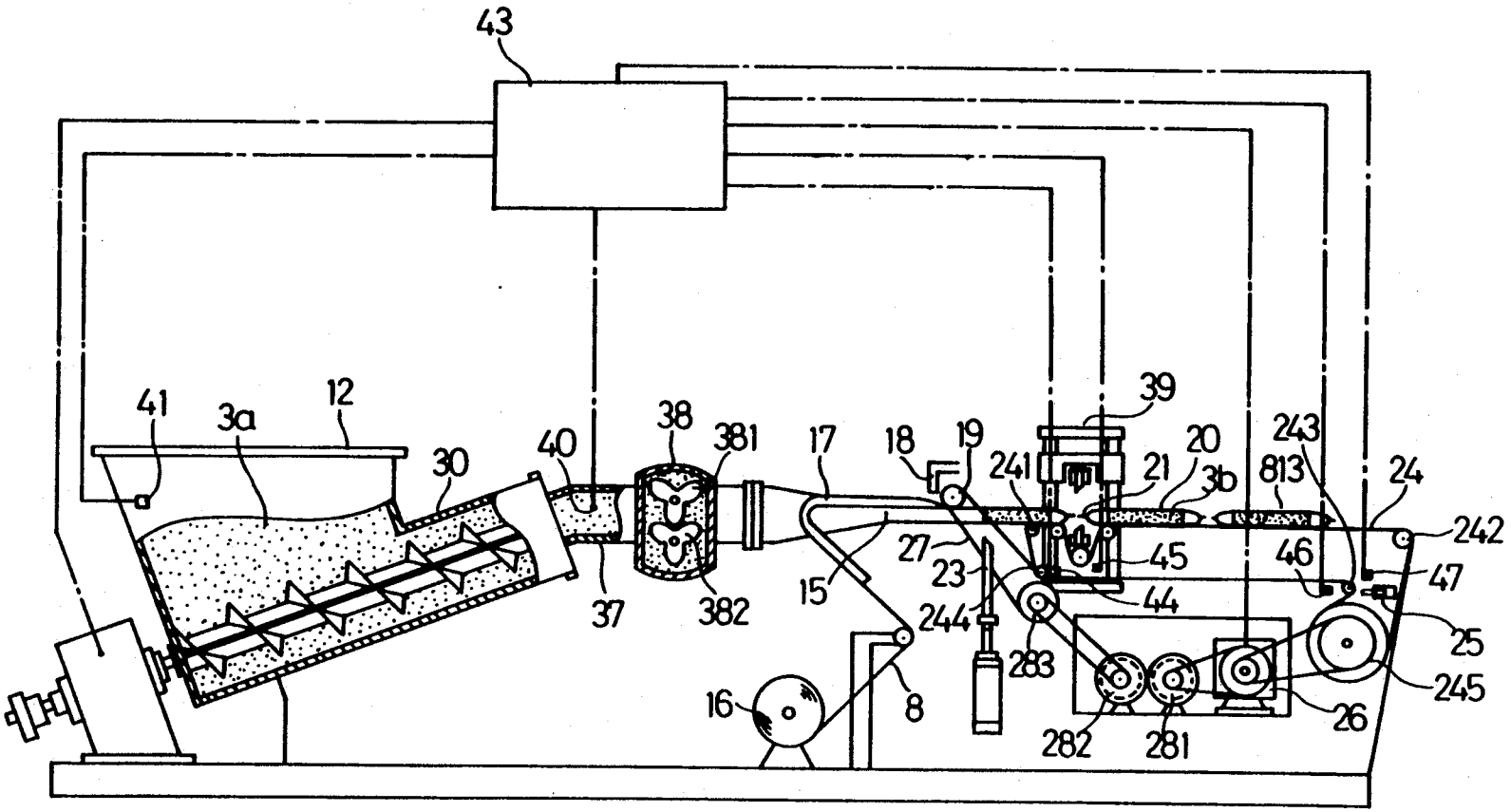
FIG. 1 is a front view with sectional portions in part, showing an embodiment of a surimi processing apparatus according to this invention.
Figure 2:
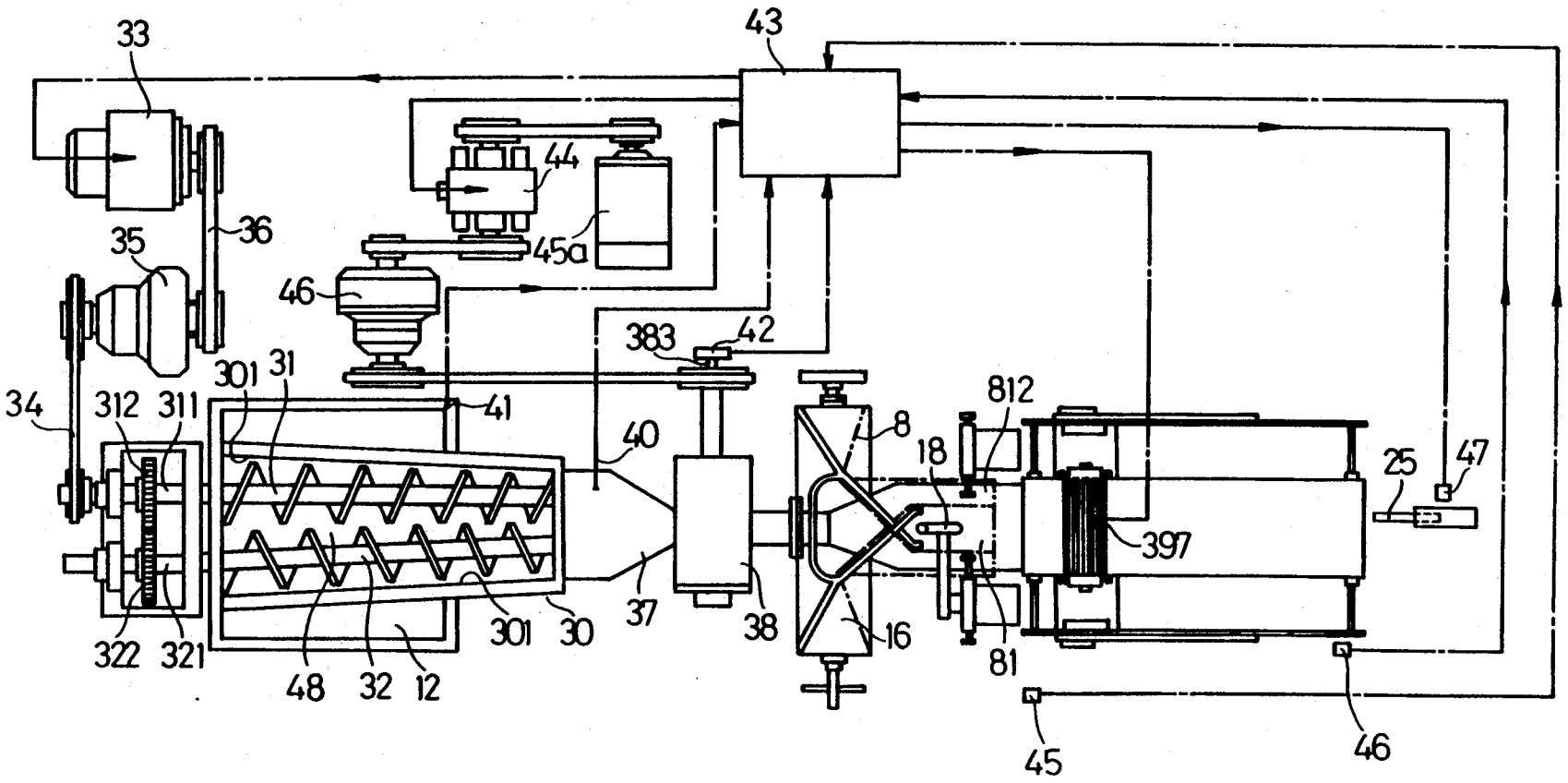
FIG. 2 is a plain view with sectional protions in part, showing the embodiment illustrated in FIG. 1.
Figure 5:
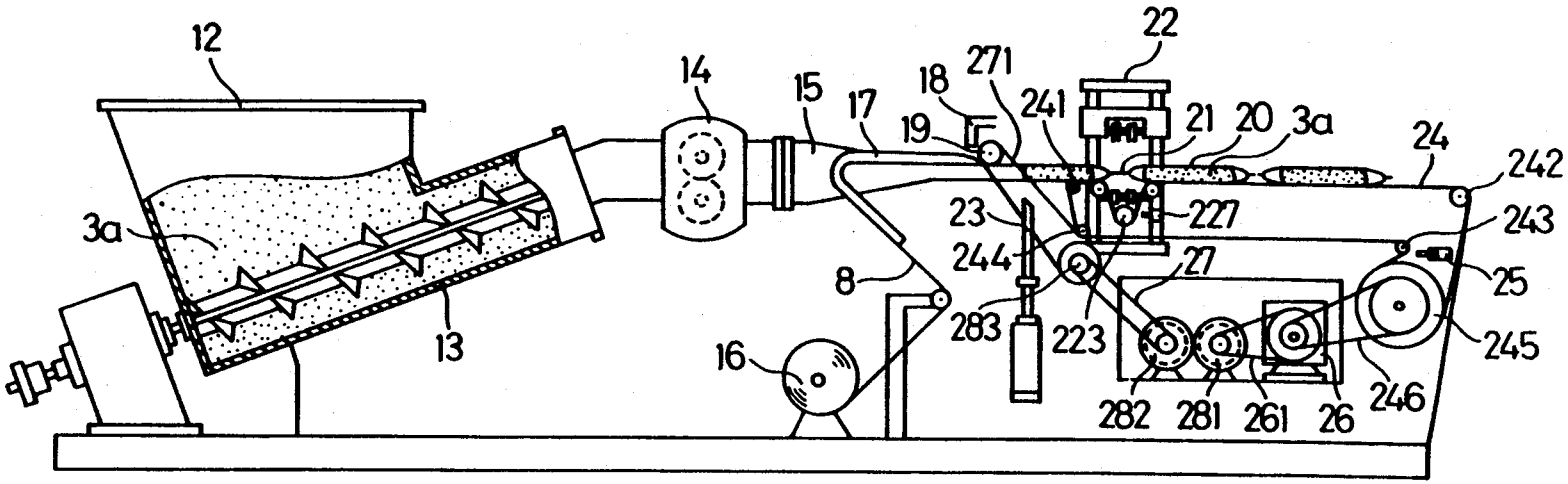
Fig. 5 PRIOR ART
FIG. 5 is a front view with fragmentary portions in part, which shows a conventional surimi processing apparatus.

Referring to FIGS. 1 and 2, like the prior art example shown in FIG. 5, reference numeral 3*a* designates a surimi, 8 a plastic film, 12 a feed hopper, 15 a forming tube, 16 a film winding roll, 17 a forming bar, 18 a heat sealer, 19 a feed roller, 20 a wrapping tube, 21 an empty portion, 23 a cutter, 24 a feed conveyor, 241 to 244 guide rollers, 245 a drive roller, 25 a returning piston, 26 a main drive motor, and 27 a belt.

In FIGS. 1 and 2, the surimi 3*a* is fed into the feed hopper 12 from the top opening inlet thereof, and it is progressivly discharged from the bottom exit of the feed hopper 12. The screw feeder 30 consisting of a pair of screws 31 and 32 are provided in a bottom position of the feed hopper 12 such that it extends obliquely upwards. Screws 31 and 32 are rotated in opposite directions thereof by a drive motor 33. Namely, screw shafts 311 and 321 have respective gears 312 and 322 mounted on the rear end thereof. One gear 312 has a rotation shaft connected via a belt 34 to a speed reduction unit 35, which is in turn coupled via a belt 36 to the drive motor 33.

Screws 31 and 32 are arranged so as to form a loose mesh between screws 31 and 32. Thereby, a clearance between screws 31 and 32 forms a return path 48 as will be described later in detail. While forming return path 48 between screws 31 and 32, screws 31 and 32 are mounted without any gap with respect to an inner wall 301 of the casing of the screw feeder 30, and an exit of the screw feeder is connected with a communication chamber 37. With this construction, when the surimi pressure prevailing in the communication chamber 37 is increased beyond a reference range, surimi 3*a* fed by screws 31 and 32 flows backwards through the return path 48. In this way, surimi 3*a* flows through the communication chamber 37 with a constatnt density at all time, and consequently there does not exist the possibility of spoiling the character or quality of the surimi.

The communication chamber 37, which is connected with the exit of the screw feeder 30, has its leading end connected with a feed pump 38. The surimi 3*a* is supplied via the communication chamber 37 to the feed pump 38. The communication chamber 37 serves to connect the screw feeder 30 with the feed pump 38, and also to maintain a uniform density of the surimi 3*a*. To this end, the communication chamber 37 is constructed such that its capacity is sufficiently large for homogenizing the density of the surimi flowing through the communication chamber 37, in spite of a fluctuation of surimi pressure applied by the screw feeder 30.

However, an excessively large capacity of the communication chamber 37 spoils the feeding capability of the screw feeder 30. Therefore, the capacity of the connecting chamber 37 should be set within a range, such as not to spoil the feeding capability of the screw feeder 30.

Namely, the surimi flowing out of the feed hopper 12 enters the screw feeder 30, and then the surimi is transfered to the communication chamber 37, by aid of the torque of screws 31 and 32. The surimi 3*a* remains in the communication chamber 37 for a while, and serves to regulate the density of the surimi 3*a*, thereby resulting in the surimi having a constant density. In other words, after a density regulation of the surimi 3*a* in the communication chamber 37, the surimi 3*a* with constant density is fed to the feed pump 38. The feed pump 38 is not a gear pump, but a volume type pump with a pair of rotors 381 and 382 serving to feed the surimi 3*a* in constant quantities. In detail, usage of the conventional gear pump causes a rupture of the fibrous structure which constitutes a characteristic of the surimi 3*a*. In contrast, usage of the volume type pump does not cause any ruptures of the fibrous structure of the surimi 3*a*, during the course of feeding the surimi 3*a*, although the volume type pump has no capability of withdrawing surimi from the communication chamber 37.

Thus, the provision of the communication chamber 37 and the feed pump 38 makes it possible to feed the surimi 3*a* with a constant density into the inlet of the feed pump 38 and to flow out from the outlet of the feed pump 38.

On the outlet side of the feed pump 38 is provided a forming tube 15, in which the surimi is formed into a plate-like shape, while it flows through along the overall lengh of the forming tube 15. The resultant plate-like shaped surimi is extruded out of an opening outlet of the forming tube 15. Plastic film 8, which is rewound off the film winding roll 16, is fed through the forming bar 17 onto the forming tube 15, with its wrapping up the outer periphery of the forming tube 15, so as to form an overlap portion 81 (shown in FIG. 2) by overlapping opposed marginal edges of the film 8.

The overlap portion 81 is heat sealed by the heat sealer 18, with an interposition of the overlap portion 81 between the heat sealer 18 and the outer periphery of the forming tube 15, thus forming a continuous wrapping tube 812. The wrapping tube 812 advances to the leading end of the forming tube 15, by the aid of the feed roller 19 disposed on the forming tube 15. The feed roller 19 is driven by the main drive motor 26 via a pair of gears 281 and 282, the pulley 283 and the belt 27. At this case, immediately after its flowing out from the leading end of the forming tube 15, the plate-like surimi is continuously advancing beyond the leading end of the forming tube 15, and sequently enters the wrapping tube 812, thereby wrapping up the plate-like surimi with the wrapping tube 812. Adjacent to the leading end of the forming tube 15, is provided the cutter 23 serving to move upwards and downwards. The cutter 23 has a cutting edge with a rounded portion on its tip. A moving path of the cutter 23, along which the cutter 23 moves upwards and downwards, is spaced with a small distance from the leading end of the cutter 23. Accordingly, the cutting edge of the cutter 23 moves upwards and then has at its rounded portion an indirect contact with the plate-like surimi through the wrapping tube 12.

At this instance, the cutter 23 does not cut the wrapping tube 812, but cuts the plate-like surimi as it is being packed by the wrapping tube 812, into units 3*b* each with a predermined weight, thus achieving an accurate division of the plate-like surimi.

Figure 6:
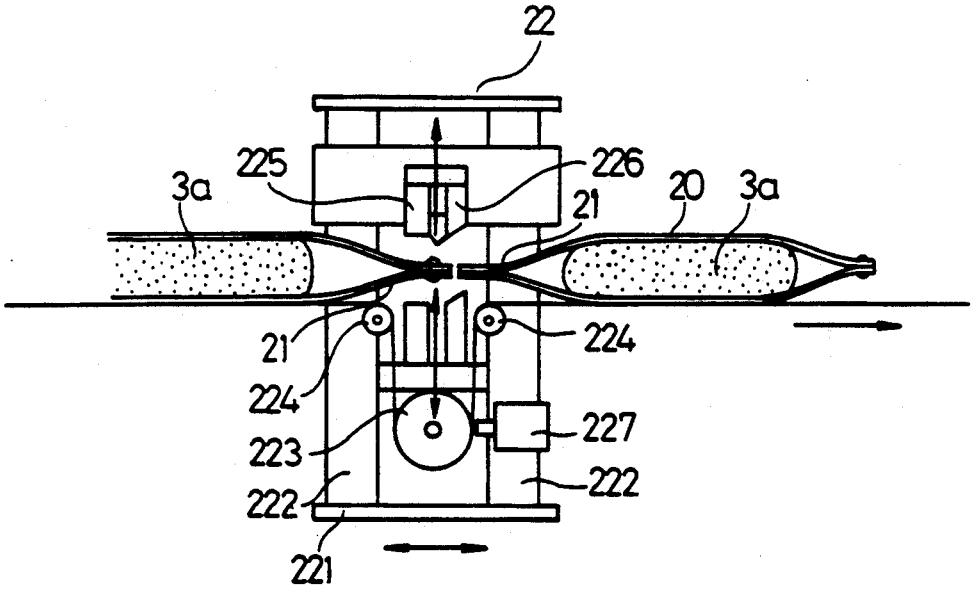
Fig. 6 PRIOR ART
FIG. 6 is a fragmentary enlarged-scale view showing a cutter/sealer shown in FIG. 5.

Adjacent to the leading end of the forming tube 15 is a novel cutter/sealer 39 with a construction different from a conventional cutter/sealer shown in FIG. 6.

The cutter/sealer 39 includes two heat sealing means 395 enabling a formation of two sealing portions on the wrapping tube 812 along two parallel lines each perpendicular to the length-wise direction of the wrapping tube 812, and also cutting means 396 enabling a formation of cutting portion on the wrapping tube 812 at an area ranging between two parallel sealing portions. Additionally, the cutter/sealer 39 enables the continuous advancement by aid of the feed conveyor 24.

Figure 3:
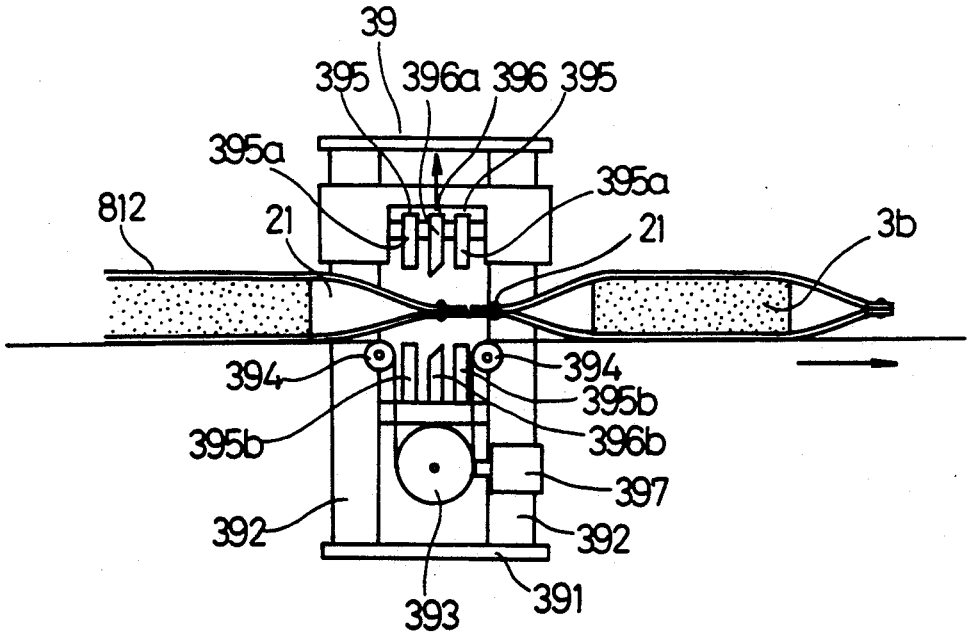
FIG. 3 is a fragmentary enlarged-scale view showing a cutter/sealer shown in FIGS. 1 and 2.
Figure 4:
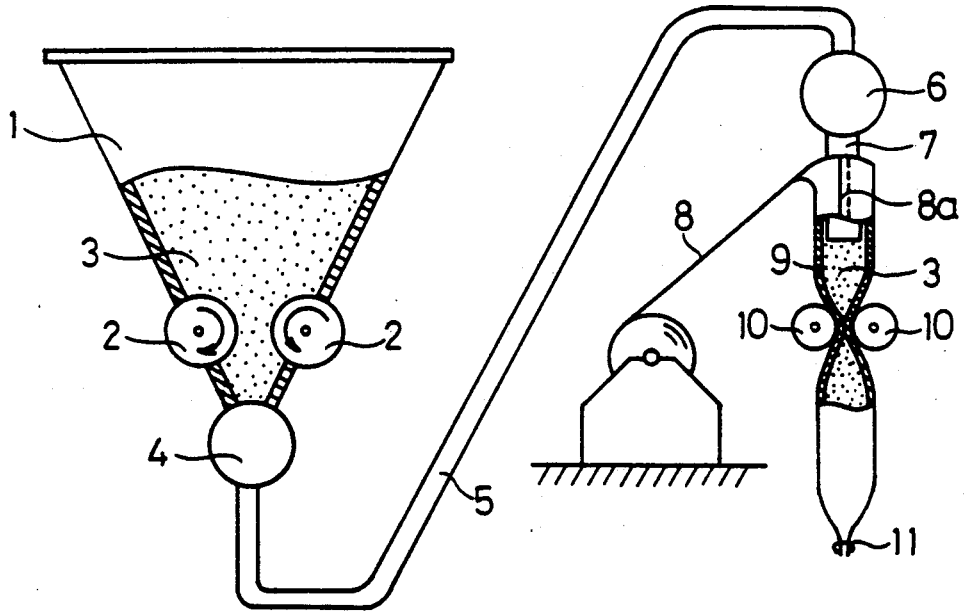
Fig. 4 PRIOR ART
FIG. 4 is a front view with fragmentary portions in part, showing a conventional sausage making machine.

Referring to FIGS. 6 and 3, the cutter/sealer 39, like the prior art example, shown in FIG. 3, includes a reciprocal base 391, a pair of support posts 392, a central guide roller 392 and two guide rollers 394 each disposed on opposite sides of the roller 392. A pair of support posts 392 support two heat sealing means 395, respectively and cutting means 396 interposed therebetween. Each heat sealing means 395 includes upper and lower sealing elements 395*a*, and 395*b* opposed to each other, so that these elements can be raised and lowered toward or away from one another. Consequently, the approach of heat sealing elements 395*a* and 395*b* of heat sealing means 395 causes to form two sealing portions on the wrapping tube 812, and also the approach of cutting elements 396*a* and 396*b* of cutting means 396 achieves simultaneously or sequentially a cutting of the wrapping tube 812 at the area ranging between two sealing portions.

When the cutter/sealer 39 is in the starting position adjacent to the leading end of the forming tube 15, the cutter/sealer 39 is connected to the feed conveyor 24 by an engagement of the connecting element 397 and as a result the cutter/sealer 39 is moved forward along with the feed conveyor 24. When the cutter/sealer 39 reaches to the ending position adjacent to the trailing end of the apparatus, it is separated from the feed conveyor 24, by a disengagement of the connecting element 397 from the conveyor 24, and as a result the cutter/sealer 39 stops at the ending position.

At the ending position, a return piston 25 is activated to return the cutter/sealer 39 to its starting position.

In the apparatus having the above contruction, the communication chamber 37 is provided with a pressure sensor 40, and also the feed hopper 12 is provided with a level sensor 41. Further, a shaft 383 of the feed pump 38 is provided with a pulse generator 42, such as a rotary encoder, and the like, which seves to detect the rotation rate of the feed pump 38 as a pulse signal from the pulse generator 38. The pulse signal from the pulse generator 42 is supplied to a control memory circuit 43. Both pressure signal from the pressure sensor 40 and level signal from the the level sensor 41 are supplied to the control memory circuit 43. In the case where the surimi 3*a* with a constant density is fed from the communication chamber 37 to the feed pump 38, the feeding rate of the surimi 3*a* can be regulated according to the rotation rate of the feed pump 38, due to the fact that the feed pump 38 is constructed as a volume type pump. Thus, the feeding rate of the surimi 3*a* can be detected as the pulse signal from the pulse generator 42. Further, the extent to which the surimi is fed to the communication chamber 37 can be obtained by the detection of the pressure signal from the pressure sensor 40, while the detection of the level signal from level sensor 41 obtains the surimi feeding level in the feed hopper 12.

In the apparatus including the pressure sensor 40, the level sensor 41 and the pulse generator 42, when the level signal reaches a reference level having a constant value and simultaneously the pressure signal is in a reference range, the control memory circuit 43 provides operation command signals to the drive motor 33 serving to feed the surimi 3*a* from the screw feeder 30 to the communication chamber 37. Simultaneously, the periodical on-off operation of the clutch brake 44 causes an intermittent driving of the feed pump 38. Thus, intermittent driving of the feed pump 38 causes the surimi 3*a* to flow out in a predetermined quantity into the forming tube 15. The surimi flowing out from the forming tube 15 is inserted into the wrapping tube 812, which is formed on the outer periphery of the forming tube 15, and the surimi unit with predetermined weight is packed with the wrapping tube 812.

The on-off operation of the feed pump 38 may be carried out in any way. In a preferable embodiment, the drive motor 45*a* is connected via the clutch brake 44 with the speed reduction unit 46*a*, and the on-off operation of the clutch brake 44 is achieved by the operation command signal from the control memory circuit 43. Namely the control memory circuit 43 counts pulses from the pulse generator 42 serving to detect a rotation rate of the feed pump 38 as a pulse signal. When the rotation rate of the feed pump 38 reaches a predetermined rotation rate, the control memory circuit 43 provides an "off" signal to the clutch brake 44. In this case, when a pulse signal corresponding to rotation rate of the feed pump 38, reaches a predetermined rotation rate, the control memory circuit 43 provides an "off" signal to the clutch brake. The clutch brake 44 serves to cut off the driving torque transmitted without intermittence by the drive motor 45*a*. The cut-off action causes to stop the transmission of the rotation torque from speed reduction unit 46*a* to the feed pump 38. After a lapse of a predermined period of time, the control memory circuit 43 supplies an "on" signal to the clutch brake 44. As a result, by action of the clutch brake 44, the transmission of the rotation torque of the drive motor 45*a* to the feed pump 38 commences. As described above, accurate division of the surimi 3*a* into units 3*b* each with constant weight can be carried out by the feed pump 38 serving to rotate within a prederminded period. Such intermittent rotation of the feed pump 38 is generated when the pressure signal representing the surimi pressure prevailing in the communication chamber 37 is in a reference range and at the same time the level signal representing the feeding level formed by the surface of the surimi occupied in the feed hopper 12 is above a predetermined level. However, when the pressure signal falls out of the reference range or when the level signal is below a predetermined level, at least the clutch brake 44 is actuated by an operation command signal from the control memory circuit 43 so as to stop the transmission of the rotation torque from the drive motor 45*a* into the feed pump 38. More specifically, when the pressure signal is outside the reference range and the level signal represents a level below the reference level, the operation command signal representing a stop signal is supplied from the control memory 43 to the drive motor 45*a* and the clutch brake 44, thereby stopping the operation of the screw feeder 30 and the feed pump 38. Further, when the pressure signal is within the reference range even if the level signal becomes below the reference level, the screw feeder 30 and the feed pump 38 are continuously operated to continue feeding the surimi 3*a* from the screw feeder 30 to the communication chamber 37, while the surimi is intermittently fed from the feed pump 38 to the forming tube 15.

On the contrary, when the presure signal gets out of the reference range, even if the level signal is above a reference level, the control memory circuit 43 supplies an "off" signal to the clutch brake 44 to stop feeding the surimi by the feed pump 38, while the surimi feeding from the screw feeder 30 to the communication chamber 37 continues. Thus, the continuation of the surimi feeding from the screw feeder 30 causes the pressure signal of the communication chamber 37 to reach within the reference range. At this instance, the surimi feeding by the feed pump 38 is resumed.

Namely, when a fluctuation of the density of the surimi supplied by the screw feeder 30 to the communication chamber 37 occurs due to a variation of the amount of the surimi being fed to the communication chamber 37 and a consequent variation of the surimi pressure prevailing in the screw feeder 30, or when the feeding level of the feed hopper 12 falls down below the reference level, there arises an idle rotation of at least one of two screws 31 and 32 and also a consequent transportation of the surimi aggregated as a mass to the communication chamber 37. The aggregated surimi cannot be homogenized by the communication chamber 37 in spite of it remaining in the communication chamber 37, and as a result the feeding of homogeneous surimi to the feed pump 38 can not be carried out. Accordingly, in this case, the mere control of rotation of the feed pump 38 does not enable an accurate division of the surimi into units having a constant weight. Even in this case, however, some instance of maintaining the pressure signal from the communication chamber 37 within a reference range indicates in the communication chamber 37 a remainder of the homogeneous uniform density surimi with uniform density. At this instance, the feed pump 38 in continuously operated for a while and a remedy for a rapid increase in the feeding rate of the surimi to be fed to the feed hopper 12 is taken, thereby preventing the pressure signal of the communication chamber 37 from falling down below a reference range. Even with such remedy treatment, when a shortage of the surimi in the communication chamber 37 results after the fall of the pressure signal representing the surimi pressure prevailing in the communication chamber 37, the pressure signal gets out of the reference range, and the control memory circuit 43 supplies an "off" signal to the clutch brake 44 to stop the surimi feeding of the feed pump 38.

On the other hand, even if the level signal from the feed hopper 12 is within the reference range, there arises a fluctuation of the density of the surimi 3 existing in the communication chamber 37 on such occasion that the pressure signal representing the surimi pressure in the communication chamber 37 gets out of the reference range.

Accordingly, in this case, the surimi flowing out from the feed pump 38 does not have a homogeneous density, and consequently it can not be divided with high accuracy into units 3*b* each with of a constant weight, by mere control of the rotation rate and period of the feed pump 38. Accordingly, at this case, the control memory circuit 43 serves to supply an "off" signal to the clutch brake 44 to stop the surimi feeding of the feed pump 38.

Additionally, it is important that the density of the surimi 3*a* passing through the communication chamber 37 be maintained within a predetermined range. In the case, that the amount of the surimi fed by the screw feeder 30 is in excess of an amount of the surimi fed by the feed pump 38, there results an extreme concentration of the surimi 3*a* while passing through the communication chamber 37 and consequent the fibrous structure included in the surimi 3*a* becomes spoiled. For this reason, the screw feeder 30 has a construction, such that surimi 3*a* is permitted to return from the communication chamber 37 to the screw feeder 30, on the occurence of an increase in the surimi pressure prevailing in the chamber 37 beyond the reference range. The surimi returning means may be constructed by provising a separate return path bridged between the communication chamber 37 and the screw feeder 30. Alternatively, a return path may be formed by a gap defined between each of the screws 31 and 32 and the inner wall surface 301 of the casing of the screw feeder 30. The former return path complicates the construction and therefore is not able to regulate all of the surimi pressure prevailing in communication chamber 37. Further, the latter return path causes a reduction of the feeding capability of the screw feeder 30 and an adherence of the surimi 3*a* to the inner wall surface 301 of the casing of the screw feeder 30.

For this reason, according to this invention, a pair of screws 31 and 32 are provided with a loose mesh relation to each other. The return path 48 is formed between two screws 31 and 32 and also it is related to the pitches of the two screws 31 and 32. For example, if each pitch of the screws 31 and 32 is set to 150±10 mm, the two screws 31 and 32 are disposed with a deviation of approximately 0.3 to 0.7 times the unit pitch thereof. Thereby, the return path 48 is formed between the two screws 31 and 32. This is because if the deviation is beyond the range of 0.3 to 0.7 times the unit pitch, the function of the return path can not be sufficiently fulfilled and the surimi 3*a* can not be uniformly fed by the screw feeder 30. More specifically, where the feed pump 38 is constructed as a volume type pump consisting of a pair of rotors, the surimi withdrawal force of the volume type pump is further reduced, compared to the prior art gear pump. For this reason, a surimi feeding capacity of the screw feeder is maintained within a certain range. If the surimi pressure prevailing in the communication chamber 37 is detected and then increased beyond the reference range, a reverse flow of the surimi through the return path 48 between the two screws 31 and 32 is caused to maintain the surimi pressure prevailing in the communication chamber 37 within the reference range. More specifically, if the surimi pressure prevailing in communication chamber 37 exceeds a reference range or reaches the upper limit thereof, the surimi 3*a* being fed by the two screws 31 and 32 of the screw feeder 30 does not enter the communication chamber 37 but flows back for a while through the return path 48 between the two screws 31 and 32. On the other hand, when the surimi 3*a* flows out from the communication chamber 37 to the feed pump 38 so that the surimi pressure prevailing in communication chamber 37 is reduced to a certain extent from the upper limit of the reference range, the surimi 3*a* begins to be fed into the communication chamber 37 in correspondence to the reduction.

Further, in order to detect the starting and ending positions of the cutter/sealer 39, a starting position sensor 45 and an ending position sensor 46 are provided. These sensors 45 and 46 are constructed as sensor switches with their output terminals connected to the control memory circuit 43. When the starting and ending positions of the cutter/sealer 39 are detected respectively by the sensors 45 and 46, each of the detection signals is supplied to the control memory circuit 43. Further, the output side of the connecting element 397 for connecting and disconnecting the cutter/sealer 39 to the feed conveyor 24 and a pneumatic valve 47 for operating the return piston 25 are connected to the control memory circuit 43.

When the cutter/sealer 39 is returned by the returning piston 25 to its starting position, the sensor 45 detects this position to provide a detection signal. As a result, the control memory circuit 43 provides an operation signal to the connecting element 397 to operate the same. The cutter/sealer 39 is moved forward along with the feed conveyor 24. Further, when the cutter/sealer 39 is moved forward to reach the ending position, this position is detected by the sensor 46. As a result, the control memory circuit 43 provides a signal to operate the connecting element 397 and returning piston 25. The cutter/sealer 39 is separated from the feed conveyor 24 and then returned to the starting position by the returning piston 25.

We claim:

1. An apparatus for automatically feeding and packing surimi of fish or shellfish, comprising: a feed hopper having a top inlet for feeding said surimi therefrom and a bottom outlet for discharging said surimi therefrom, a screw feeder connected to said bottom outlet of said feed hopper, said screw feeder having two screws serving to pass said surimi through said screw feeder, a feed pump for feeding a predetermined quantity of said surimi flowing from an exit of said screw feeder, a forming tube for forming into a desired shape said surimi flowing out of said feed pump, a wrapping tube forming means for forming a plastic film into a continuous wrapping tube to be packed with said surimi, a communication chamber disposed between said screw feeder and said feed pump;

a pressure gauge, disposed at said communication chamber, for detecting a surimi pressure prevailing in said communication chamber;

a level gauge, disposed at said feed hopper, for detecting a level of said surimi in said hopper;

control means for supplying a driving signal to said feed pump only when said level gauge detects said level greater than or equal to a reference level and said pressure gauge detects said surimi pressure in excess of a reference pressure; and a return path formed between said two screws of said screw feeder.

2. The apparatus according to claim 1, wherein said return path is formed between said two screws disposed in a loose mesh relation to each other.

3. The apparatus according to claim 1, wherein said return path is formed between said two screws disposed with a deviation of 0.3 to 0.7 times an unit pitch of each of said two screws.

4. The apparatus according to claim 1, wherein said feed pump is connected through a clutch brake to a drive motor, and wherein while said feed pump is provide with a rotary encoder for detecting a rotation rate of said feed pump, said revolving rate is counted by a control unit, and upon reaching a predetermined reference revolving rate said control unit supplies a signal to drive said clutch brake thereby disconnecting said drive motor from said feed pump.

5. An apparatus for automatically feeding and packing surimi of fish or shellfish, comprising: a feed hopper having a top inlet for feeding said surimi therefrom and a bottom outlet for discharging said surimi therefrom, a screw feeder connected to said bottom outlet of said feed hopper, said screw feeder having two screws serving to pass said surimi through said screw feeder, a feed pump for feeding a predetermined quantity of said surimi flowing from an exit of said screw feeder, a forming tube for forming into a desired shape said surimi flowing from said outlet of said feed pump, a wrapping tube forming means for forming a plastic resin film into a continuous wrapping tube to be packed with said surimi, a communication chamber disposed between said screw feeder and said feed pump;

a pressure gauge, disposed at said communication chamber, for detecting a surimi pressure prevailing in said communication chamber;

a level gauge, disposed an said feed hopper, for detecting a level of said surimi in said hopper;

control means for supplying a driving signal to said feed pump only when said level gauge detects said level greater than or equal to a reference level and said pressure gauge detects said surimi pressure in excess of a reference pressure;

a return path formed between said two screws of said screw feeding;

cutting means, disposed adjacent to a leading end of said forming tube, for cutting said surimi having a desired shape into surimi units without cutting said wrapping tube, so as to form a gap between two consecutive surimi units having no surimi therebetween;

a feed conveyor for continuously advancing forward the wrapping tube along with said surimi units therein;

a cutter/sealer for cutting and simultaneously sealing said empty portion of said wrapping tube during an advancement of said cutter/sealer along with said feed conveyor;

connecting means for connecting or disconnecting said cutter/sealer with said feeding conveyor; and at least two sensor elements for respectively detecting a starting and ending position of said cutter/-sealer reciprocating therebetween, one sensor element serving to detect a time for said cutter/sealer to reach said ending position and for outputting a first detecting signal to said control means in response thereto, thereby actuating through said control means a return of said cutter/seal up to said starting position, a second sensor element element serving to detect a time for said cutter/sealer to reach said starting position and for for outputting a secondary detecting signal to said control means in response thereto, thereby actuating through said control means an advancement of said cutter/-sealer toward said ending position.

6. The apparatus according to claim 5, wherein said cutting means is disposed beneath said leading end of said forming tube having a lower cutter lifting up whose edge reaches a horizontal line extending over from a top level of said forming tube.

7. The apparatus according to claim 5, wherein said connecting means are constructed so as to be connected with said feed conveyor by a command signal fed from said control means immediately after supplying said first signal to said control means.

8. The apparatus according to claim 5, wherein said cutter/sealer comprises sealing means and a pair of cutting means disposed at opposite sides of said sealing means.

* * * * *